US008378759B2

(12) United States Patent
Margomenos et al.

(10) Patent No.: US 8,378,759 B2
(45) Date of Patent: Feb. 19, 2013

(54) FIRST AND SECOND COPLANAR MICROSTRIP LINES SEPARATED BY ROWS OF VIAS FOR REDUCING CROSS-TALK THERE BETWEEN

(75) Inventors: Alexandros Margomenos, Pasadena, CA (US); Amin Rida, Atlanta, GA (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 325 days.

(21) Appl. No.: 12/697,119

(22) Filed: Jan. 29, 2010

(65) Prior Publication Data

US 2010/0182103 A1 Jul. 22, 2010

Related U.S. Application Data

(63) Continuation-in-part of application No. 12/355,526, filed on Jan. 16, 2009, now Pat. No. 7,990,237.

(51) Int. Cl.
*H01P 3/08* (2006.01)

(52) U.S. Cl. ..... 333/1; 333/247

(58) Field of Classification Search ..... 333/1, 4, 333/5, 238, 246, 247
See application file for complete search history.

(56) References Cited

U.S. PATENT DOCUMENTS

| | | | | |
|---|---|---|---|---|
| 3,093,805 | A * | 6/1963 | Osifchin et al. | 333/1 |
| 4,259,743 | A | 3/1981 | Kaneko et al. | |
| 4,513,266 | A * | 4/1985 | Ishihara | 333/238 |
| 4,731,611 | A | 3/1988 | Muller et al. | |
| 5,008,678 | A | 4/1991 | Herman | |
| 5,111,210 | A | 5/1992 | Morse | |
| 5,262,783 | A | 11/1993 | Philpott et al. | |
| 5,481,268 | A | 1/1996 | Higgins | |
| 5,724,042 | A | 3/1998 | Komatsu et al. | |
| 5,867,120 | A | 2/1999 | Ishikawa et al. | |
| 5,909,191 | A | 6/1999 | Hirshfield et al. | |
| 5,933,109 | A | 8/1999 | Tohya et al. | |
| 6,040,524 | A * | 3/2000 | Kobayashi et al. | 174/36 |
| 6,107,578 | A | 8/2000 | Hashim | |
| 6,624,786 | B2 | 9/2003 | Boyle | |
| 6,703,965 | B1 | 3/2004 | Ming et al. | |
| 6,717,544 | B2 | 4/2004 | Nagasaku et al. | |
| 6,756,936 | B1 | 6/2004 | Wu | |
| 6,771,221 | B2 | 8/2004 | Rawnick et al. | |
| 6,833,806 | B2 | 12/2004 | Nagasaku et al. | |

(Continued)

FOREIGN PATENT DOCUMENTS

| | | |
|---|---|---|
| JP | 6224629 | 8/1984 |
| JP | 4040003 | 2/1992 |

(Continued)

OTHER PUBLICATIONS

Alexandros D. Margomenos, "Three Dimensional Integration and Packaging Using Silicon Micromachining", dissertation at the University of Michigan; Ann Arbor, Michigan; 2003.

*Primary Examiner* — Benny Lee
(74) *Attorney, Agent, or Firm* — Snell & Wilmer LLP

(57) ABSTRACT

An apparatus for reducing crosstalk including a substrate having a bottom surface and a top surface defining a horizontal plane, a ground plane coupled to the bottom surface of the substrate, first and second microstrip lines formed on the top surface of the substrate, the first and second microstrip lines formed on the top surface of the substrate and spaced apart from one another, and a first plurality of vias traveling through the substrate from the top surface of the substrate to the ground plane and positioned between the first and second microstrip lines for reducing crosstalk between the first and second microstrip lines.

16 Claims, 17 Drawing Sheets

U.S. PATENT DOCUMENTS

| | | | | |
|---|---|---|---|---|
| 6,909,405 | B2 | 6/2005 | Kondo | |
| 6,933,881 | B2 | 8/2005 | Shinoda et al. | |
| 7,154,432 | B2 | 12/2006 | Nagasaku et al. | |
| 7,170,361 | B1 * | 1/2007 | Farnworth | 333/1 |
| 7,298,234 | B2 * | 11/2007 | Dutta | 333/246 |
| 7,310,061 | B2 | 12/2007 | Nagasaku et al. | |
| 7,408,500 | B2 | 8/2008 | Shinoda et al. | |
| 7,532,153 | B2 | 5/2009 | Nagasaku et al. | |
| 7,586,450 | B2 | 9/2009 | Muller | |
| 7,639,173 | B1 | 12/2009 | Wang et al. | |
| 7,733,265 | B2 | 6/2010 | Margomenos et al. | |
| 7,830,301 | B2 | 11/2010 | Margomenos | |
| 7,881,689 | B2 | 2/2011 | Leblanc et al. | |
| 8,022,861 | B2 | 9/2011 | Margomenos | |
| 2005/0156693 | A1 | 7/2005 | Dove et al. | |
| 2006/0146484 | A1 | 7/2006 | Kim et al. | |
| 2007/0052503 | A1 | 3/2007 | Quach et al. | |
| 2008/0061900 | A1 * | 3/2008 | Park et al. | 333/1 |
| 2009/0000804 | A1 | 1/2009 | Kobayashi et al. | |
| 2010/0182107 | A1 | 7/2010 | Margomenos et al. | |
| 2012/0026043 | A1 | 2/2012 | Margomenos et al. | |

FOREIGN PATENT DOCUMENTS

| | | |
|---|---|---|
| JP | 5267931 | 10/1993 |
| JP | 8114667 | 5/1996 |
| JP | 8186437 | 7/1996 |
| JP | 11186837 | 7/1999 |
| JP | 2001-077608 | 3/2001 |
| JP | 2001-189623 | 7/2001 |
| JP | 2001-512640 | 8/2001 |
| JP | 2005-516446 | 6/2005 |

* cited by examiner

FIRST AND SECOND COPLANAR MICROSTRIP LINES SEPARATED BY ROWS OF VIAS FOR REDUCING CROSS-TALK THERE BETWEEN

CLAIM OF PRIORITY UNDER 35 U.S.C. §120

The present application for patent claims priority from and is a continuation-in-part application of U.S. patent application Ser. No. 12/355,526, entitled "System and Method for improving performance of Coplanar Waveguide Bends at mm-wave frequencies," filed Jan. 16, 2009, now U.S. Pat. No. 7,990,237, issued Aug. 2, 2011 and assigned to the assignee hereof and hereby expressly incorporated by reference herein.

BACKGROUND

1. Field

The invention relates to apparatus and methods for mounting and interconnecting a Radio Frequency Integrated Circuit (RFIC) for automotive radar applications. More particularly, the invention relates to an interconnection apparatus and method for low cross-talk chip mounting for automotive radars.

2. Background

Many automotive designers and manufacturers are seeking to produce high-density microwave modules that achieve good isolation between circuit elements. In particular, transceiver applications (e.g., radar and communication RF front-ends) need to have good isolation to ensure receiver sensitivity and prevent leakage between channels.

Multilayer architectures incorporating complex circuits on a common substrate material pose some challenging isolation problems. For example, when circuits are printed on a common substrate, surface waves excited by planar discontinuities or leaky modes tend to induce parasitic currents on neighboring interconnects and circuits leading to unwanted interference. This parasitic coupling becomes increasingly more problematic as circuits are printed on multilayered structures for higher density and smaller size. In such multilayered structures, proximity effects are dependent on the interconnect geometry. The layout design and relative placement of lines, vias and vertical transitions should be carefully considered in order to reduce any unwanted interference.

Isolation becomes more important and more problematic at the connections to the RFIC chip since most of the signal transmission lines converge on a very small area (typically around 3×3 $mm^2$) adjacent to the RFIC chip and are interconnected to the RFIC chip. Due to their close proximity, these signal transmission lines tend to interfere with one another causing deleterious effects on the radar performance. Furthermore, RFIC chips (e.g., SiGe BiCMOS and RF CMOS chips) tend to integrate multiple signal transmission lines (e.g., 4, 8 or 16) on a single chip, further emphasizing the need to have good isolation between the signal transmission lines.

FIG. 1 is a schematic view of a prior art 3D integrated radar RF front-end system 100 having antennas 105 that are combined together using transmission lines 110 on a liquid crystal polymer (LCP) substrate 120. The antennas 105 are printed on the front-side and the transmission lines 110 are printed on the backside. The transmission lines 110 are connected to an RFIC chip 115. The transmission lines 110 provide good performance in terms of loss and low crosstalk (i.e., every channel is completely isolated from the others and extremely low levels of crosstalk are achievable). Instead of using machined metallic waveguides, the transmission lines 110 are planar lines that are printed on the LCP substrate 120. The planar lines are microstrip lines at the topside and coplanar waveguides (CPW) at the backside.

The LCP substrate 120 may be a single 100 um thick LCP layer, as shown, mounted on a 200-400 um thick, FR4 grade printed circuit board (PCB) that contains all the digital signal processing and control signals. The LCP substrate 120 has a planar phased array beam-steering antenna array 105 printed on one side. The signals from each antenna 105 are RF transitioned to the backside with a 3D vertical transition 125. In the backside, the signals converge to the RFIC chip 115.

Although the foregoing prior art 3D integrated radar RF front-end system 100 is helpful in reducing the crosstalk between these types of transmission lines 110, additional improvements can be made to reduce the crosstalk between these types of transmission lines 110 as these lines converge towards the RFIC chip 115 on the backside. Also, additional improvements can be made to reduce the crosstalk between CPW interconnections or transmission lines. Therefore, a need exists in the art for an interconnection apparatus and method for low cross-talk chip mounting for automotive radars.

SUMMARY OF THE INVENTION

An apparatus for reducing crosstalk including a substrate having a bottom surface and a top surface defining a horizontal plane, a ground plane coupled to the bottom surface of the substrate, first and second microstrip lines formed on the top surface of the substrate, the first and second microstrip lines formed on the top surface of the substrate and spaced apart from one another, and a first plurality of vias traveling through the substrate from the top surface of the substrate to the ground plane and positioned between the first and second microstrip lines for reducing crosstalk between the first and second microstrip lines.

In one embodiment, an apparatus for reducing crosstalk includes a liquid crystal polymer substrate having a bottom surface and a top surface, a broken ground plane having first and second sides separated by an opening, the broken ground plane coupled to the bottom surface of the liquid crystal polymer substrate, and first and second coplanar waveguides formed on the top surface of the liquid crystal polymer substrate, the first and second coplanar waveguides are spaced apart from one another, the first coplanar waveguide is formed over the first side of the broken ground plane and the second coplanar waveguide is formed over the second side of the broken ground plane. The apparatus further includes a first set of vias traveling through the substrate from the top surface of the substrate to the first side of the broken ground plane and positioned between the first and second coplanar waveguides for reducing crosstalk between the first and second coplanar waveguides, a second set of vias traveling through the substrate from the top surface of the substrate to the second side of the broken ground plane and positioned between the first and second coplanar waveguides for reducing crosstalk between the first and second coplanar waveguides, and a RFIC chip positioned on the liquid crystal polymer substrate and connected to the first and second coplanar waveguides.

BRIEF DESCRIPTION OF THE DRAWINGS

The features, objects, and advantages of the invention will become more apparent from the detailed description set forth below when taken in conjunction with the drawings, wherein.

DETAILED DESCRIPTION OF THE INVENTION

Apparatus, systems and methods that implement the embodiments of the various features of the invention will now be described with reference to the drawings. The drawings and the associated descriptions are provided to illustrate some embodiments of the invention and not to limit the scope of the invention. Throughout the drawings, reference numbers are re-used to indicate correspondence between referenced elements and may not be described in detail in all drawings in which they appear.

Figure 1:
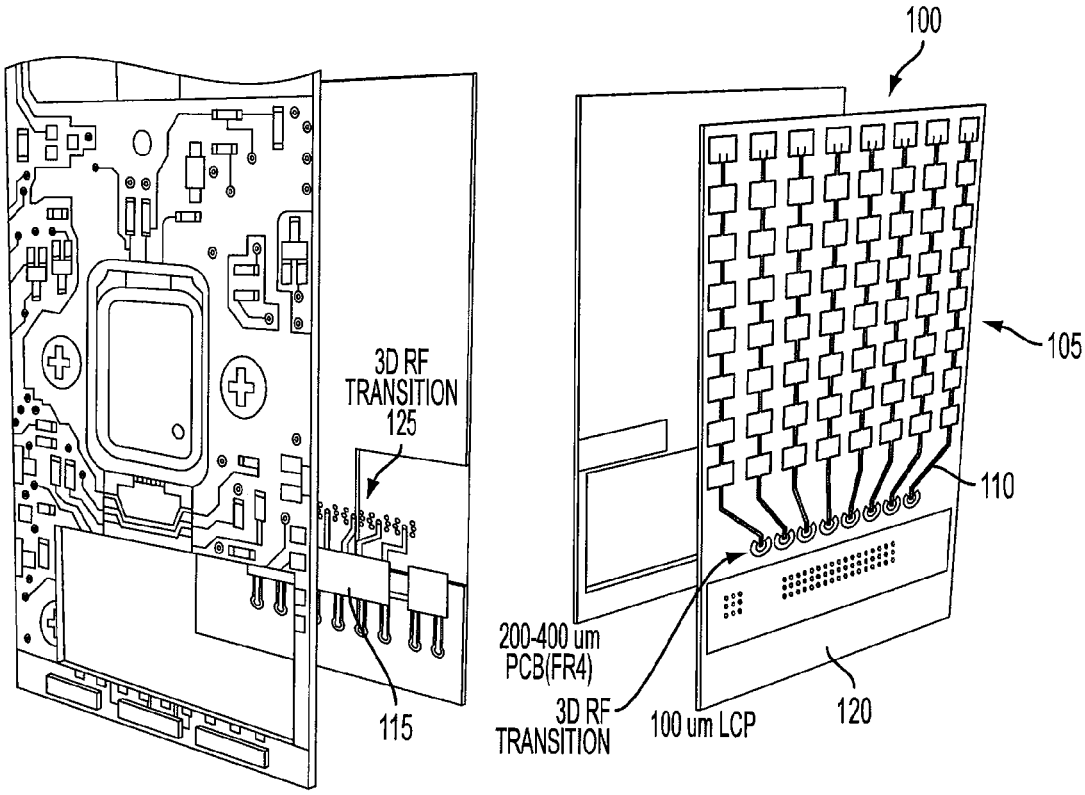
FIG. 1 PRIOR ART
FIG. 1 is a schematic view of a prior art 3D integrated radar RF front-end system having antennas that are combined together using waveguides on a liquid crystal polymer (LCP) substrate.
Figure 2:
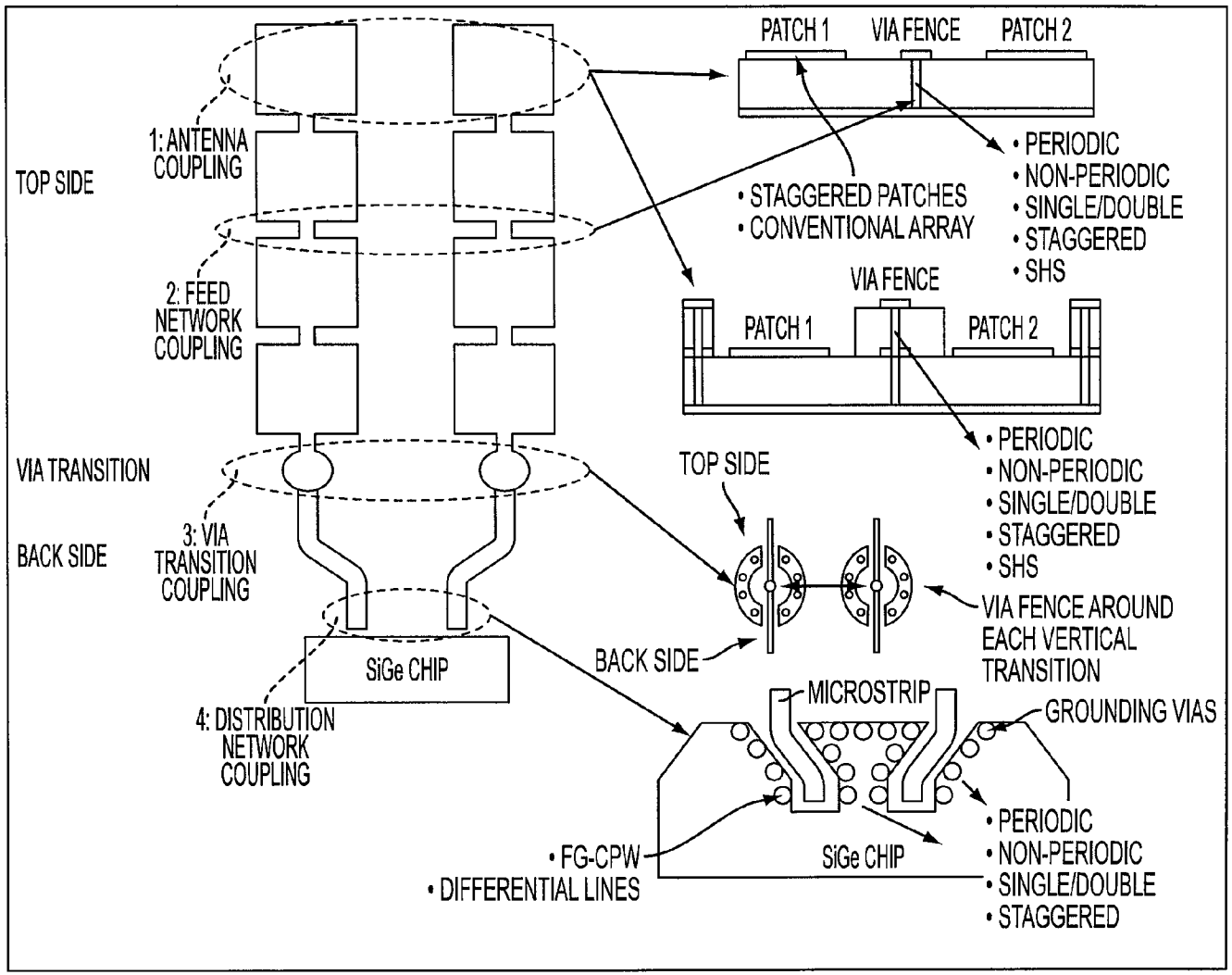
FIG. 2 is a schematic top view showing four sources of crosstalk on a three-dimensional (3D) automotive radar RF front-end according to an embodiment of the invention.

FIG. 2 shows a schematic top view on the left side of the figure with four sources of crosstalk on a three-dimensional (3D) automotive radar RF front-end 200 according to an embodiment of the invention. The four sources of crosstalk include (1) antenna coupling, (2) feed network coupling, (3) via transition coupling and (4) distributed network coupling. A schematic side view of a portion of the 3D automotive radar RF front end corresponding to the antenna coupling and feed network coupling is shown in the top right of the figure. The two sets of microstrip patch arrays (denoted by "PATCH 1" and "PATCH 2" in FIG. 2) are printed on the top side as shown, PATCH 1 and/or PATCH 2 may have STAGGERED characteristics (e.g., as described with respect to FIG. 16 below) or arranged as an unstaggered CONVENTIONAL ARRAY as labeled in FIG. 2. The via fence positioned between PATCH 1 and PATCH 2 may have PERIODIC or NON-PERIODIC structures. The via fence may have an SHS (Soft and Hard Surface) boundary structure and may include a SINGLE row (e.g., as described with respect to FIGS. 15, 18 and 23 below) or a DOUBLE row (e.g., as described with respect to FIGS. 15, 16 and 23 below), and the via fence may be STAGGERED (e.g., as described with respect to FIGS. 16 and 17 below) or unstaggered (e.g., as described with respect to FIGS. 13 and 17 below). A schematic top view of a portion of the 3D automotive radar RF front end corresponding to the via transition coupling and distribution network coupling is shown on the bottom right of the figure. Since the 3D automotive radar RF front-end 200 generally operates as a phased array (as opposed to a switched-beam array), the first and second sources of crosstalk are less critical to the system performance. The third source of crosstalk is limited due to the use of a via fence around each 3D transition formed in half-circle arcs around the vertical transitions as shown in the schematic view on the right side denoted by "VIA FENCE AROUND EACH VERTICAL TRANSITION." However, the fourth source of crosstalk is important due to the close proximity of the transmission lines that are close to the location of the transmit/receive SiGe chip. Hence, a large portion of crosstalk reduction can be achieved by reducing the parasitic coupling between the microstrip and the CPW transmission lines. CPW transmission lines may be FG-CPW (Finite Ground Coplanar Waveguide) transmission lines and/or the vias may be in DIFFERENTIAL LINES or pairs as shown on the bottom right of FIG. 2. The GROUNDING VIAS may be connected to a ground plane as discussed below with respect to FIG. 8. The via fence may have PERIODIC or NON-PERIODIC structures as denoted in FIG. 2 and may include a SINGLE row (e.g., as described with respect to FIGS. 15, 18 and 23 below) or a DOUBLE row (e.g., as described with respect to FIGS. 15, 16 and 23 below), and the via fence may be STAGGERED (e.g., as described with respect to FIG. 16 below).

Figure 3:
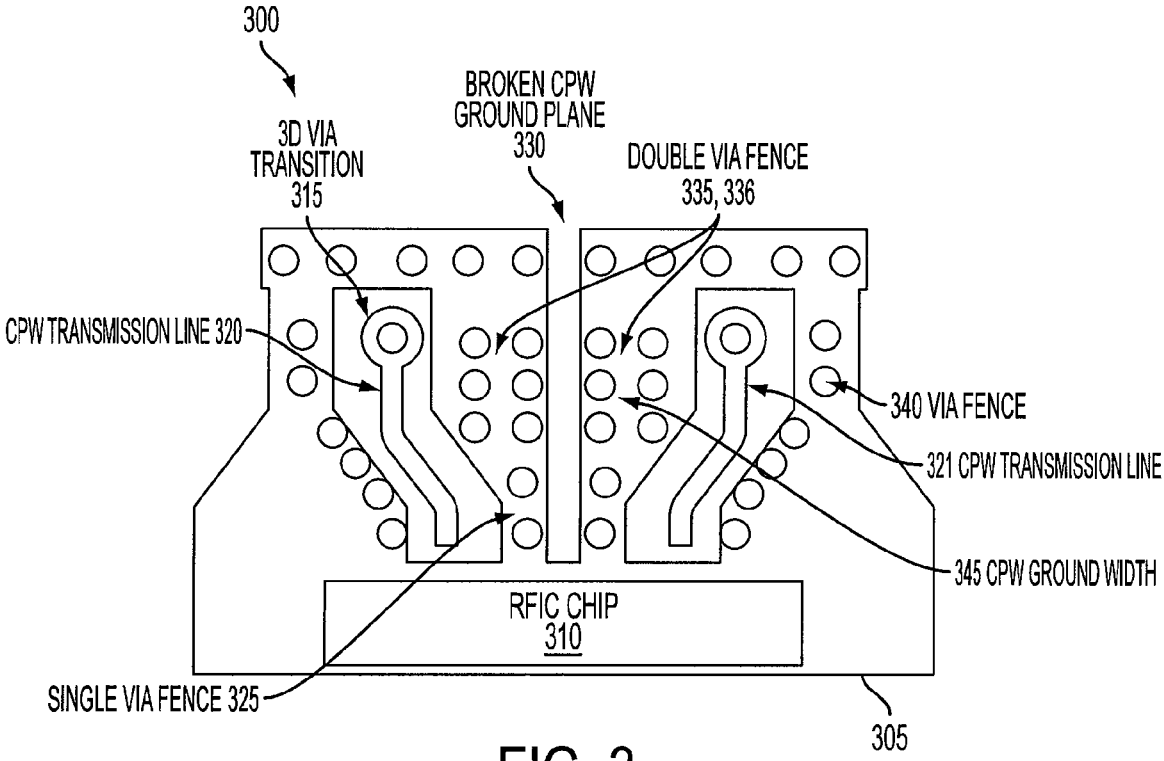
FIG. 3 is a schematic top view of a portion of a 3D automotive radar RF front-end showing the interconnection scheme between a planar beam steering antenna array on an LCP substrate and a RFIC chip according to an embodiment of the invention.

FIG. 3 is a schematic top view of a portion of a 3D automotive radar RF front-end 300 showing the interconnection scheme between a planar beam steering antenna array on an LCP substrate 305 and a RFIC chip 310 according to an embodiment of the invention. The portion of the 3D automotive radar RF front-end 300 may include a 3D via transition 315, a CPW transmission line 320, a single via fence 325, a broken CPW ground plane 330, two double via fences 335 and 336, a via fence 340, and a CPW ground width 345. The 3D automotive radar RF front-end 300 may be implemented using hardware, software, firmware, middleware, microcode, or any combination thereof. One or more elements can be rearranged and/or combined, and other radars can be used in place of the radar RF front-end 300 while still maintaining the spirit and scope of the invention. Elements may be added to the radar RF front-end 300 and removed from the radar RF front-end 300 while still maintaining the spirit and scope of the invention.

After the 3D via transition 315, the CPW transmission line 320 converges towards the RFIC chip 310. The 3D automotive radar RF front-end 300 utilizes one or more vias (e.g., the single via fence 325), made out of metallized vias, that are connected to a ground plane to isolate each CPW transmission line 320 from an adjacent or neighboring CPW transmission line 320. A center-to-center distance between adjacent vias is between about 0.5 mm to about 1.0 mm. The double via fences 335 and 336 (i.e., two vias side-by-side) allows for better isolation between CPW transmission lines 320 and 321. Each double via fence is positioned on one side of the CPW ground plane 330. As an example, each double via fences 335 and 336 has 3 sets of double vias. A double via means there are two vias positioned side-by-side. Each via may be filled with a metal material. As the CPW transmission lines 320 and 321 converge towards the RFIC chip 310, the single via fence 325 may be utilized due to size restrictions. The RFIC chip 310 is connected to the CPW transmission lines 320 and 321. A center-to-center lateral separation between the first and second microstrip lines is between about 500 μm to about 1500 μm.

The CPW ground plane 330 is broken to reduce crosstalk between the two CPW transmission lines 320 and 321. The reason for breaking or splitting the common CPW ground plane 330 is because surface waves that are created within the LCP substrate 305 can more easily propagate and parasitically couple to the adjacent CPW transmission lines 320 and 321. Also, the CPW ground plane 330 should have a width at least 3.5 times a width of the center conductor in order to achieve high isolation between the CPW transmission lines 320 and 321.

Figure 4:
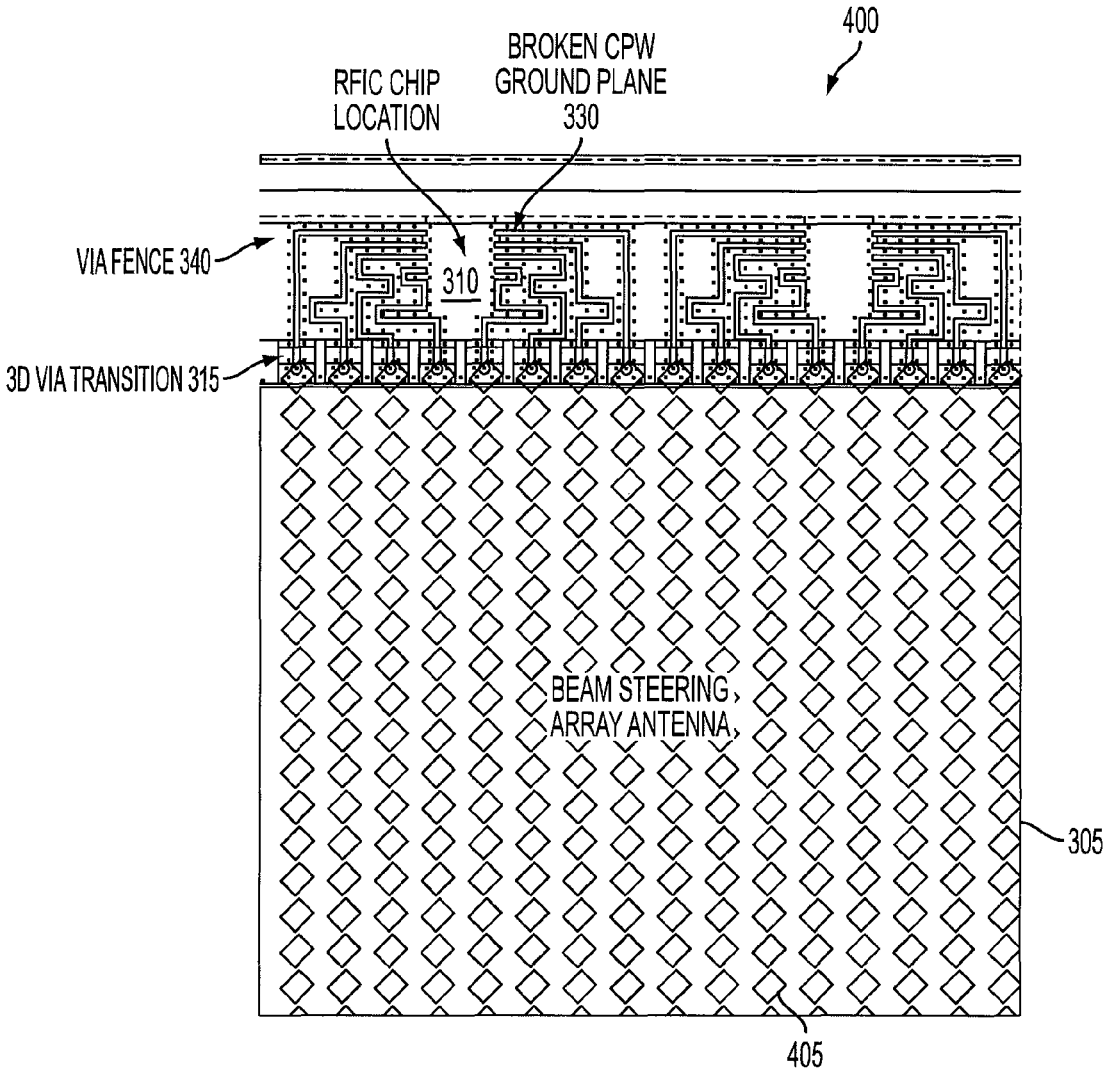
FIG. 4 is a schematic top view of a portion of a 3D automotive radar RF front-end showing how the interconnection scheme between the planar beam steering antenna array on an LCP substrate, the RFIC chip and the 3D via transition combine to form the 3D automotive radar RF front-end according to an embodiment of the invention.

FIG. 4 is a schematic top view of a portion of a 3D automotive radar RF front-end 400 showing how the interconnection scheme between the planar beam steering antenna array 405 on an LCP substrate 305, the RFIC chip 310 and the 3D via transition 315 combine to form the 3D automotive radar RF front-end 400 according to an embodiment of the invention.

Figure 5:
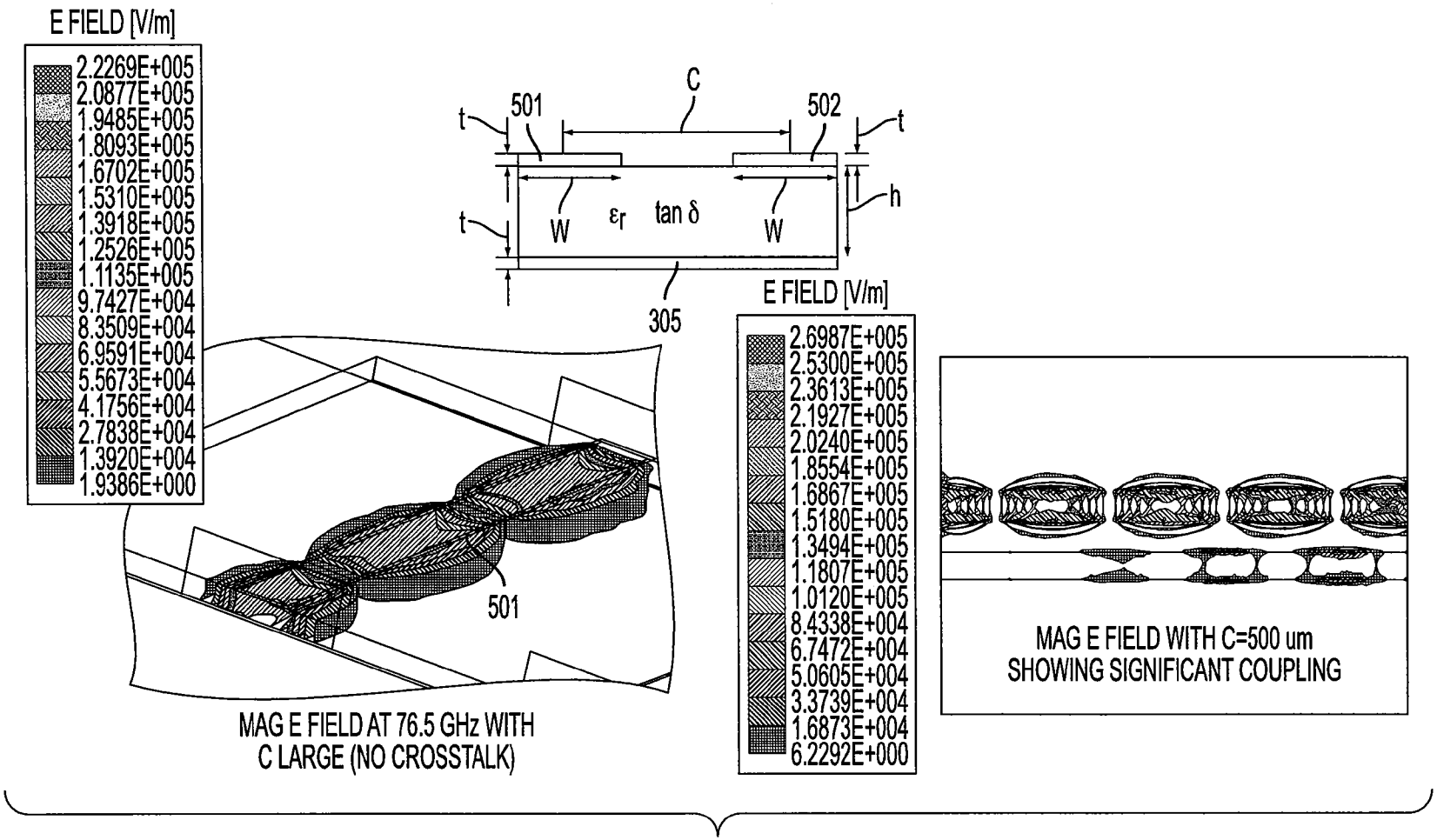
FIG. 5 includes schematic diagrams showing crosstalk between microstrip lines according to an embodiment of the invention.

FIG. 5 includes schematic diagrams showing crosstalk between microstrip lines 501 and 502 according to an embodiment of the invention. Each microstrip line 501 and 502 has a width W and a metal thickness t. Each microstrip line 501 and 502 is printed on the LCP substrate 305 (e.g., where $\epsilon_r$ is about 3.16, tan δ, thickness h). The center-to-center lateral separation between the two adjacent microstrips 501 and 502 is C, which is about 500 μm. The lower left drawing shows the various magnitudes of electric field values at 76.5 GHz, labeled in the drawing as "MAG E FIELD AT 76.5 GHz WITH C LARGE (NO CROSSTALK)" which correspond to the magnitude of electric field values listed as "E FIELD [V/m]" in the table to the left when no coupled microstrip line is present. The lower right drawing shows the various magnitude of electric field values (labeled in the drawing as "MAG E FIELD WITH C=500 μm SHOWING SIGNIFICANT COUPLING" which correspond to the magnitude of electric field values listed as "E FIELD [V/m]" in the table to the right when the second microstrip line 502 is present at a distance C away from the first microstrip line 501.

Figure 6:
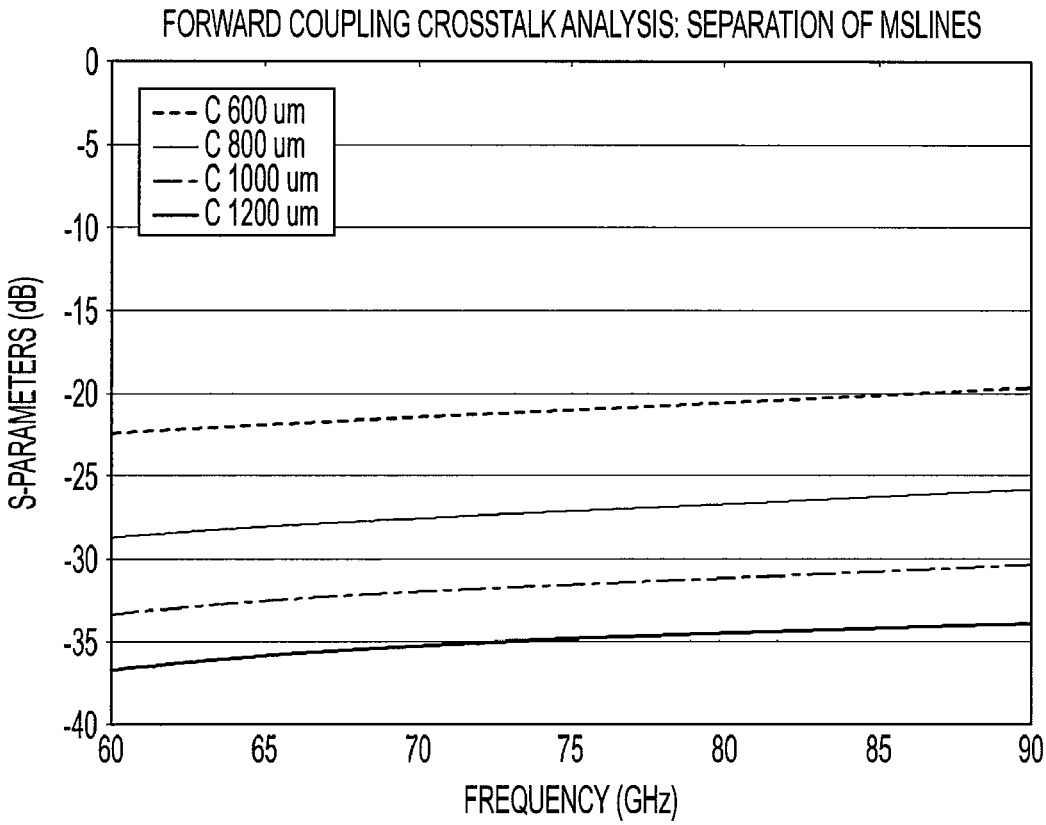
FIG. 6 is a graph of a simulated forward coupling crosstalk between the two microstrip lines of FIG. 5 for different lateral separations C according to various embodiments of the invention.
Figure 7:
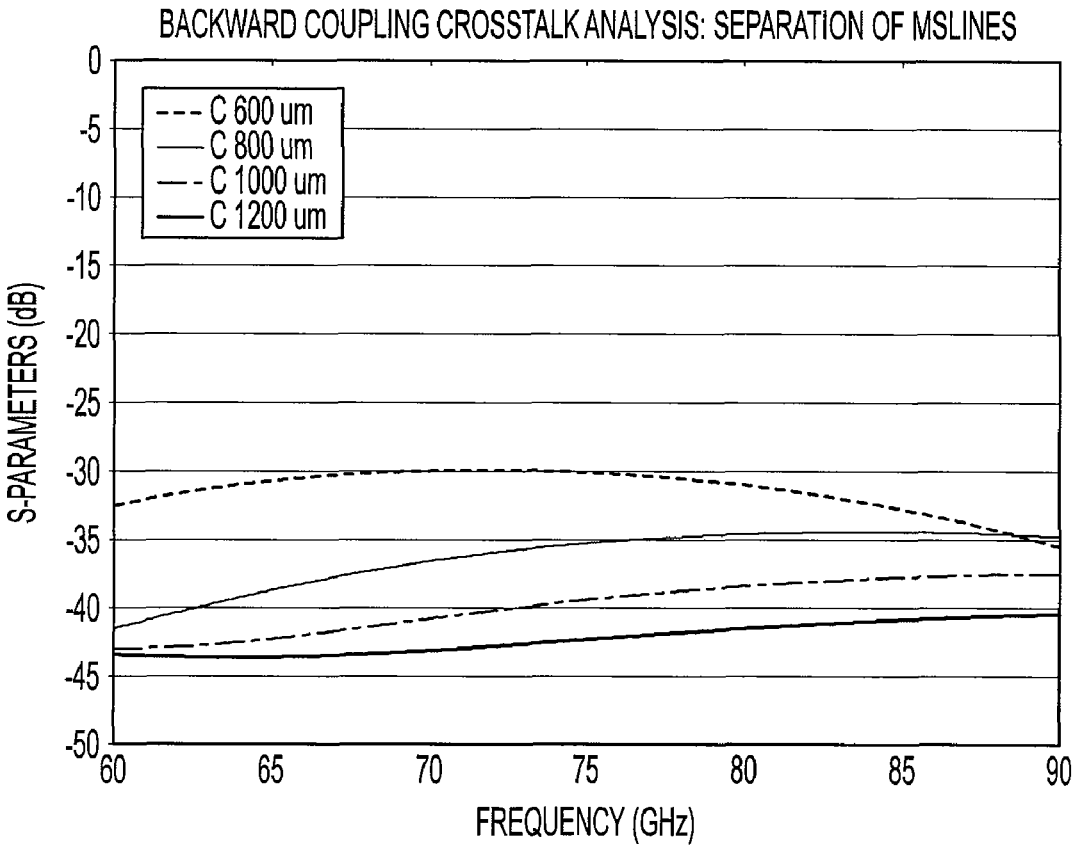
FIG. 7 is a graph of a simulated backwards coupling crosstalk between the two microstrip lines of FIG. 5 for different lateral separations C according to various embodiments of the invention.

FIG. 6 is a graph with frequency in GHz on the x-axis and S parameters in dB on the y-axis of a simulated forward coupling crosstalk between the two microstrip lines 501 and 502 of FIG. 5 for different lateral separations C (i.e. 600 μm, 800 μm, 1000 μm, 1200 μm) according to various embodiments of the invention. The forward coupling crosstalk shows a monotonic behavior versus frequency in GHz. FIG. 7 is a graph with frequency in GHz on the x-axis and S parameters in dB on the y-axis of a simulated backwards coupling crosstalk between the two microstrip lines 501 and 502 of FIG. 5 for different lateral separations C (i.e. 600 μm, 800 μm, 1000 μm, 1200 μm) according to various embodiments of the invention. The backwards coupling crosstalk shows a standing wave pattern due to surface wave modes. For small distances, the forward coupling crosstalk is in the order of −20 dB and the backwards coupling crosstalk is in the order of −30 dB.

Figure 8:
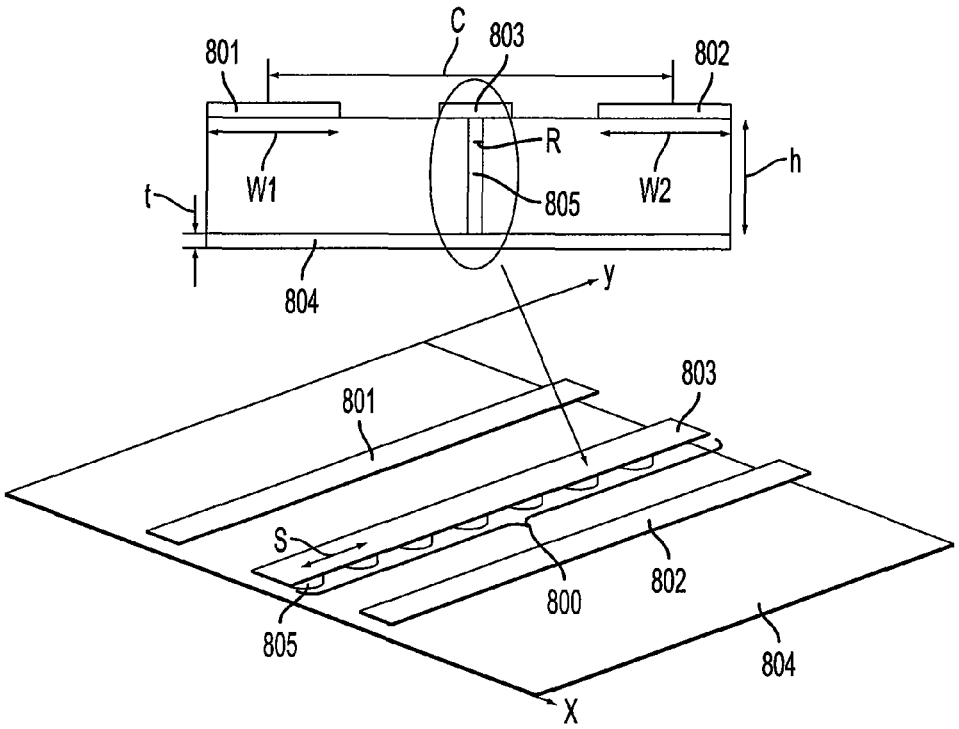
FIG. 8 is a schematic view showing a metallized via fence positioned between adjacent microstrip lines to reduce crosstalk according to an embodiment of the invention.

FIG. 8 is a schematic view with an x-y coordinate system showing a metallized via fence 800 positioned between adjacent microstrip lines 801 and 802 on a substrate of thickness h to reduce crosstalk according to an embodiment of the invention. The metallized via fence 800 includes a plurality of metallized vias 805, which are connected to a ground plane 804 of thickness t. The first microstrip line 801 has a width W1 and the second microstrip 802 line has a width W2. The center-to-center lateral spacing C (e.g., about 500 μm) is the lateral distance between adjacent microstrip lines 801 and 802. The plurality of metallized vias 805 have center-to-center spacing S of about 200 μm and have a metallized layer 803 extending there along. Each metallized via 805 has a radius R of about 50 μm.

Figure 9:
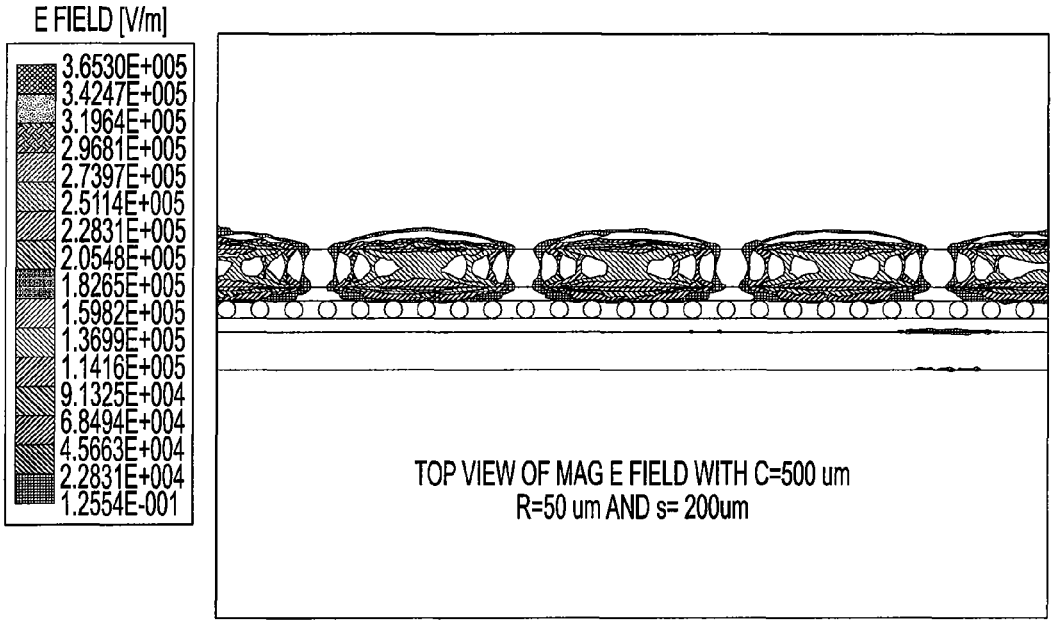
FIG. 9 is a top view showing a reduced coupled electric field due to the metallized via fence of FIG. 8 according to an embodiment of the invention.

FIG. 9 is a top view showing a reduced coupled magnitude of electric field due to the metallized via fence 800 of FIG. 8 according to an embodiment of the invention. The drawing shows the various magnitude of electric field values (i.e. E FIELD in [V/m]) listed in the corresponding table to the left for center-to-center lateral separation between two microstrips of 500 μm, metalized vias with a radius R of about 50 μm and center-to-center spacing of vias S of about 200 μm. That is, the coupled magnitude of electric field from an aggressor signal is reduced due to the addition of the metallized via fence 800.

Figure 10:
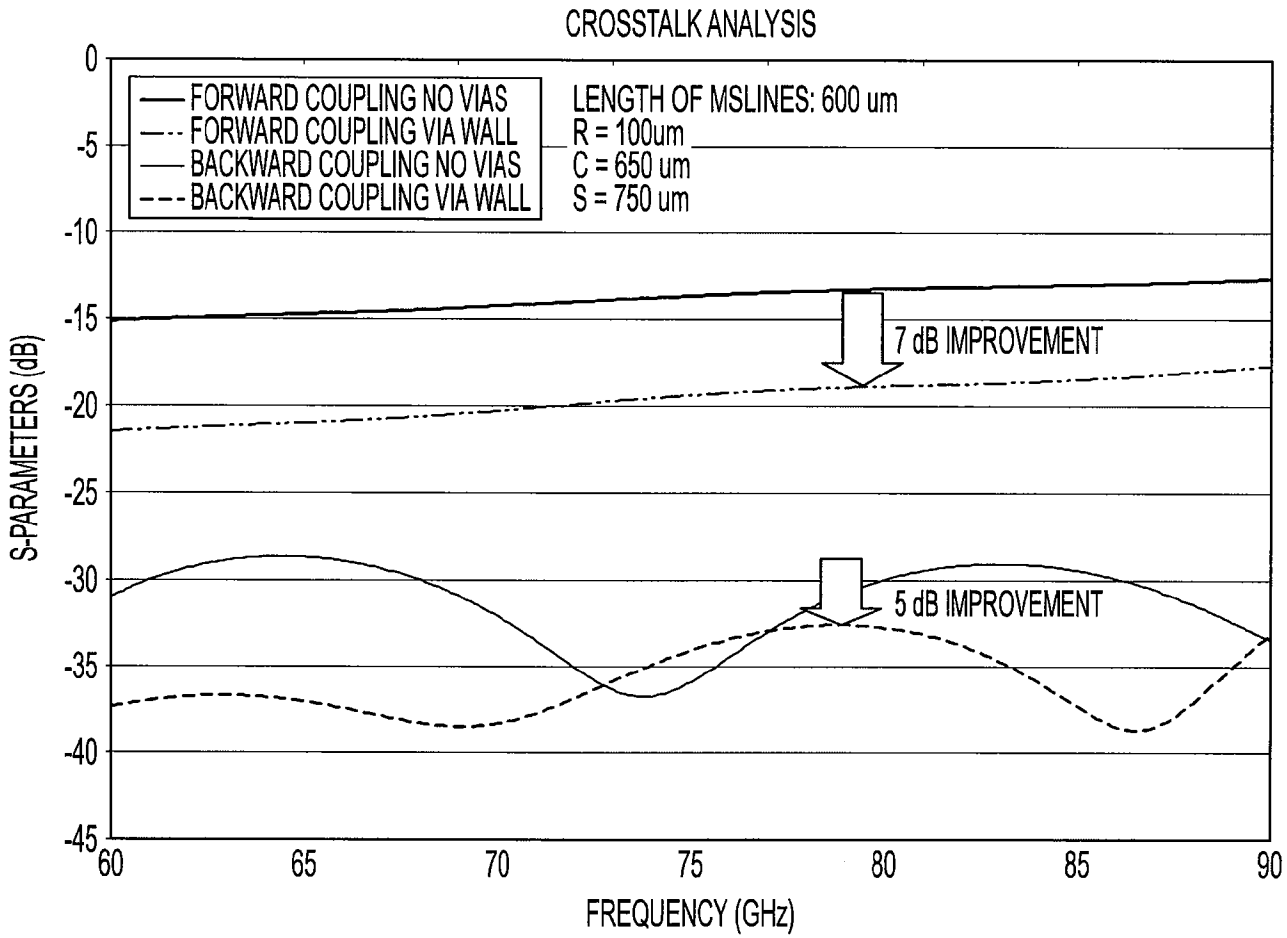
FIG. 10 is a graph comparing the crosstalk (forward and backward) between two microstrip lines with the metallized via fence and without the metallized via fence according to an embodiment of the invention.

FIG. 10 is a graph with frequency on the x-axis in GHz and S-Parameters in dB on the y-axis comparing the crosstalk (forward and backward) between two microstrip lines 801 and 802 with the metallized via fence 800 of FIG. 8 and without the metallized via fence 800 according to an embodiment of the invention. In this example, the length of the microstrip lines 801, 802 is about 600 μm, C is about 650 μm, R is about 100 μm and S is about 750 μm. As an example, the metallized via fence 800 reduces crosstalk (forward coupling and backward coupling) by about 7 dB and 5 dB, respectively. The performance of the metallized via fence 800 in reducing crosstalk also depends on the center-to-center spacing S defining a distance between two adjacent metallized vias 805. A larger spacing S (i.e., the more sparse the metallized via fence 800) equates to a lesser improvement in the crosstalk. Also, a smaller spacing S equates to better isolation between the microstrip lines 801 and 802 to reduce crosstalk. The smaller spacing S also increases the production costs due to the larger number of metallized vias 805. Therefore, a design tradeoff exists between reducing crosstalk and increasing production costs.

Figure 11:
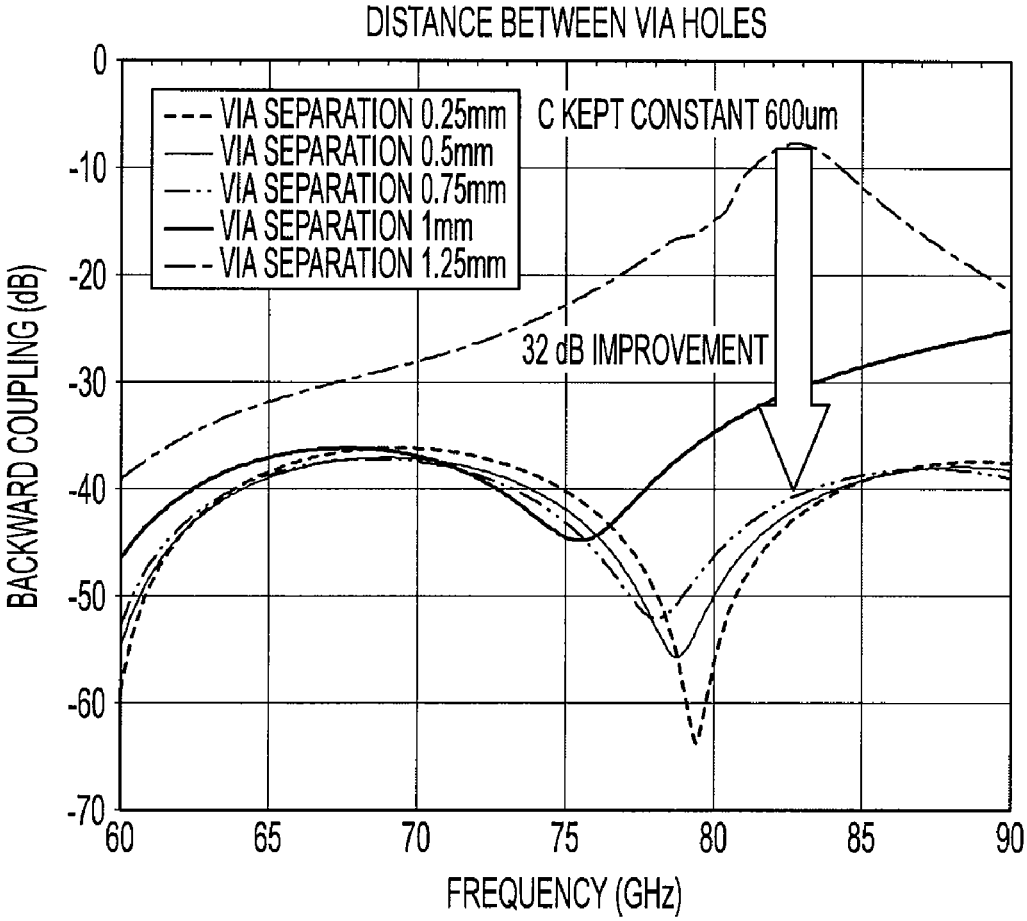
FIG. 11 is a graph showing the effects on backward crosstalk when the spacing S is reduced according to an embodiment of the invention.
Figure 12:
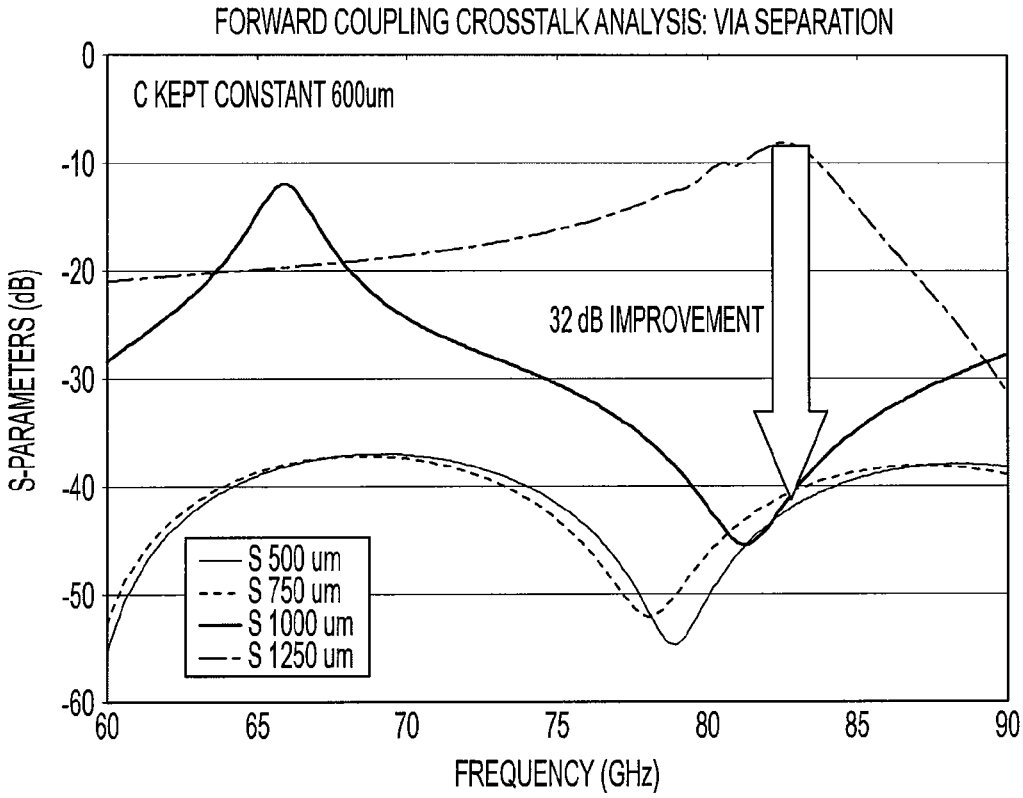
FIG. 12 is a graph showing the effects on forward crosstalk when the spacing S is reduced according to an embodiment of the invention.

FIG. 11 is a graph with frequency in GHz on the x-axis and S-Parameter for backward coupling in dB on the y-axis showing the effects on backward crosstalk when the via separating spacing S is reduced according to an embodiment of the invention. FIG. 12 is a graph with frequency in GHz on the x-axis and S-Parameter for forward coupling in dB on the y-axis showing the effects on forward crosstalk when the via separating spacing S is reduced (i.e. from 1250 μm to 1000 μm to 750 μm to 500 μm) according to an embodiment of the invention. Referring to FIGS. 11 and 12, when C is kept constant at 600 μm, a 32 dB improvement in backward and forward coupling or crosstalk is depicted when the center-to-center spacing S between via holes is reduced from 1.25 mm to 1 mm to 0.75 mm. Furthermore, reducing the spacing below 0.75 mm (i.e. to 0.5 mm and 0.25 mm) does not yield a significant reduction in crosstalk and therefore a center-to-center spacing S of about 0.75 mm is an optimal value for reducing crosstalk when the signals are being transmitted at around 77 GHz.

Figure 13:
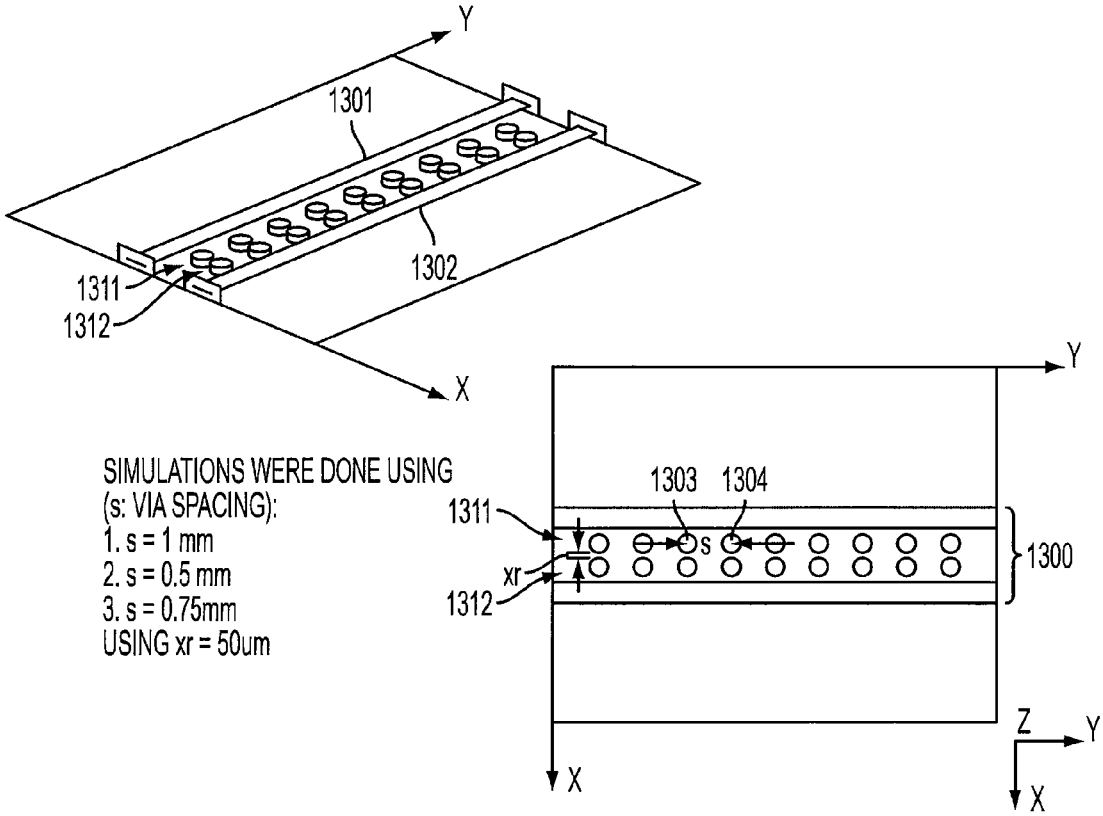
FIG. 13 is a schematic view showing two rows of metallized via fences positioned between microstrip lines to reduce crosstalk according to an embodiment of the invention.

FIG. 13 is a schematic view with an x-y-z coordinate system showing two rows of metallized via fences 1300 positioned between microstrip lines 1301 and 1302 to reduce crosstalk according to an embodiment of the invention. The first row 1311 and the second row 1312 are positioned adjacent to one another. Each row may have a plurality of metallized vias 1303. The second row 1312 of metallized vias 1303 improves the performance (i.e., reduces crosstalk) by about 15 dB. The distance xr between adjacent rows is about 50 μm, as shown in the corresponding legend on the left side of the drawing. The center-to-center spacing S between adjacent vias can be 1 mm, 0.5 mm or 0.75 mm, as shown in the corresponding legend on the left side of the drawing.

Figure 14:
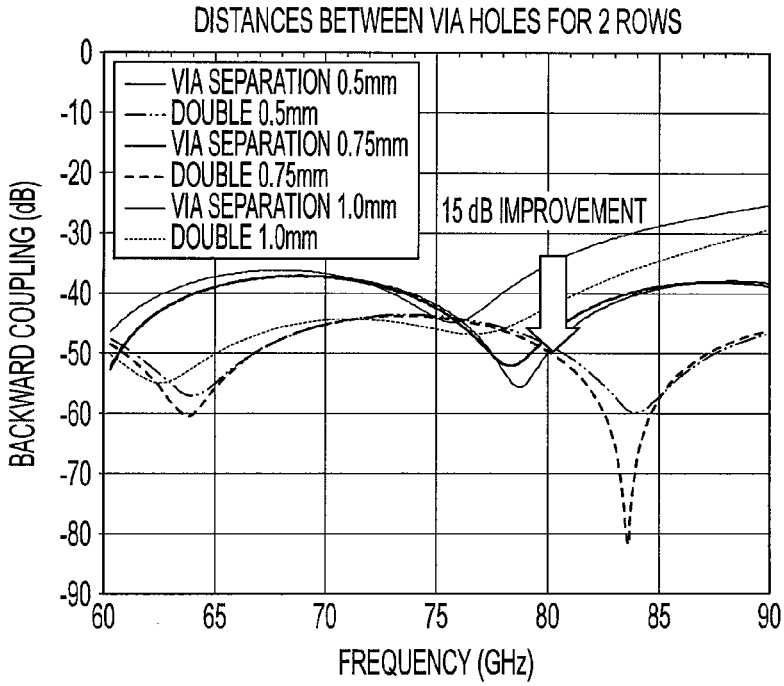
FIG. 14 is a graph comparing the crosstalk (backward coupling) between the two microstrip lines of FIG. 13 with two rows of metallized via fences having different center-to-center spacings S between two adjacent vias according to an embodiment of the invention.

FIG. 14 is a graph with frequency in GHz on the x-axis and backward coupling in dB on the y-axis comparing the crosstalk (backward coupling) between the two microstrip lines 1301 and 1302 of FIG. 13 with two rows 1311 and 1312 of metallized via fences 1300 having different center-to-center spacings S between two adjacent vias 1303 and 1304 according to an embodiment of the invention. Referring to FIG. 14, a 15 dB improvement (i.e. reduction) in backward coupling or crosstalk at frequency of approximately 80 GHz (as depicted by the downward block arrow) is achieved when a double row of vias with center-to-center spacing S of 0.75 mm is used instead of a single row of vias with center-to-center spacing S of 1 mm.

Figure 15:
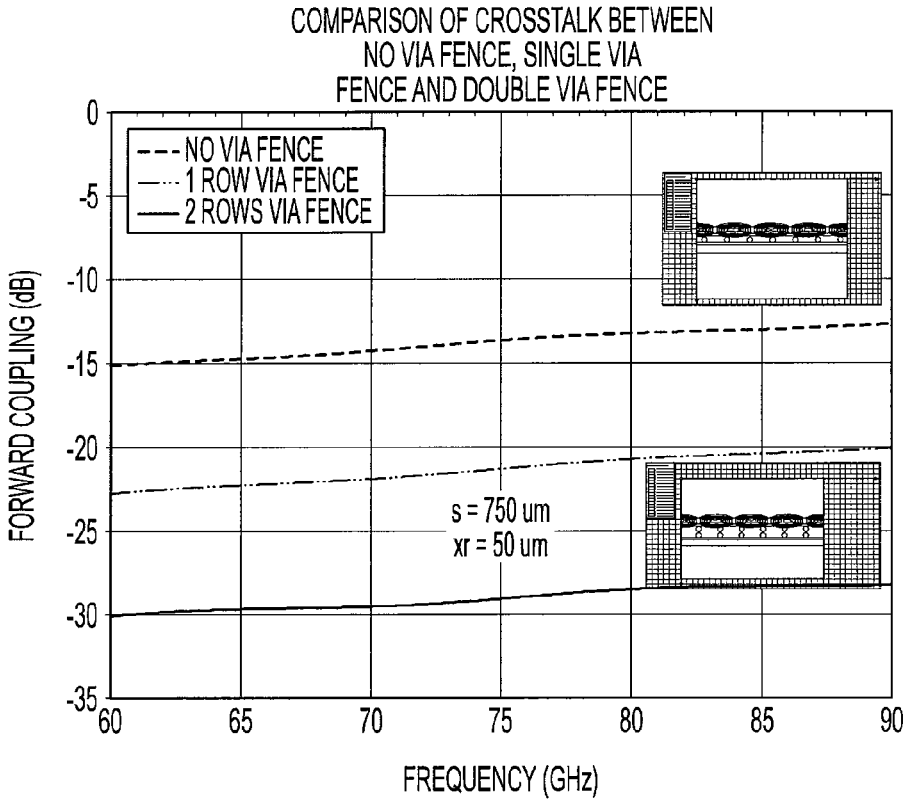
FIG. 15 is a graph comparing the crosstalk (forward coupling) between the two microstrip lines of FIG. 13 when no via fence is present, a single via fence is present, and a double via fence is present according to various embodiments of the invention.

FIG. 15 is a graph with frequency in GHz on the x-axis and forward coupling in dB on the y-axis comparing the crosstalk (forward coupling) between the two microstrip lines 1301 and 1302 of FIG. 13 when no via fence is present, a single via fence is present (with center-to-center via spacing S of 750 μm), and a double via fence 1300 (with center-to-center via spacing S of 750 μm and distance xr between adjacent double rows of 50 μm as shown in FIG. 13) is present according to various embodiments of the invention.

Figure 16:
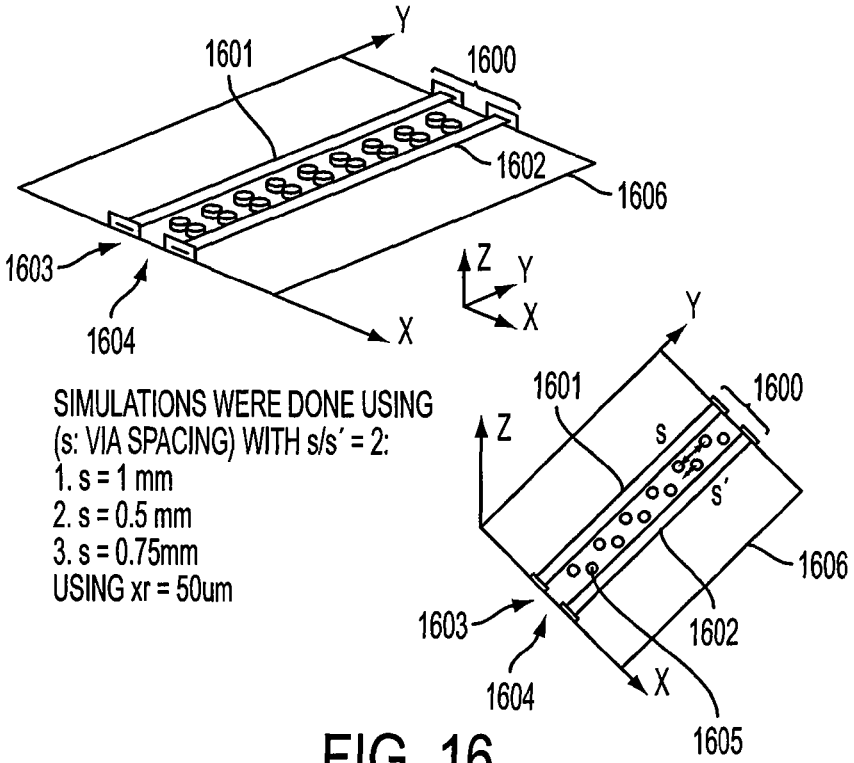
FIG. 16 is a schematic view showing a double staggered metallized via fence positioned between adjacent microstrip lines to reduce crosstalk according to an embodiment of the invention.

FIG. 16 is a schematic view with an x-y-z coordinate system showing a double staggered metallized via fence 1600 positioned between adjacent microstrip lines 1601 and 1602 to reduce crosstalk according to an embodiment of the invention. The double metallized via fence 1600 includes a first row 1603 and a second row 1604 positioned adjacent to the first row 1603. The first row 1603 and the second row 1604 have staggered metallized vias 1605. That is, each row has a plurality of staggered metallized vias 1605, which are each connected to a ground plane 1606. The first row 1603 has center-to-center spacing S and the second row 1604 has center-to-center spacing S' where S/S' is about equal to 2, as shown in the corresponding legend on the left side of the drawing. The center-to-center spacing S may be equal to 1 mm, 0.5 mm or 0.75 mm, as shown in the corresponding legend on the left side of the drawing. The distance xr between the two rows may be equal to about 50 μm, as shown in the corresponding legend on the left side of the drawing.

Figure 17:
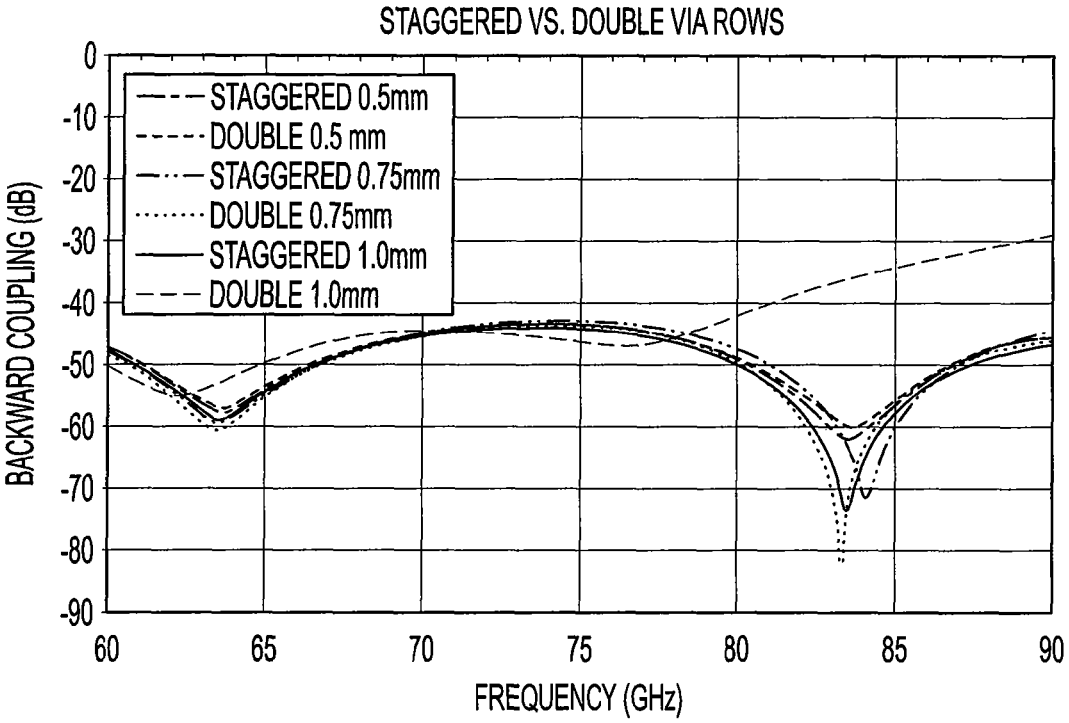
FIG. 17 is a graph comparing the crosstalk (backward coupling) between the two microstrip lines of FIG. 16 when two staggered rows are implemented and two unstaggered rows (FIG. 13) are implemented according to various embodiments of the invention.

FIG. 17 is a graph with frequency in GHz on the x-axis and backward coupling in dB on the y-axis comparing the crosstalk (backward coupling) between the two microstrip lines 1601 and 1602 of FIG. 16 when two staggered rows 1600 are implemented and two unstaggered rows 1300 (FIG. 13) are implemented according to various embodiments of the invention.

Figure 18:
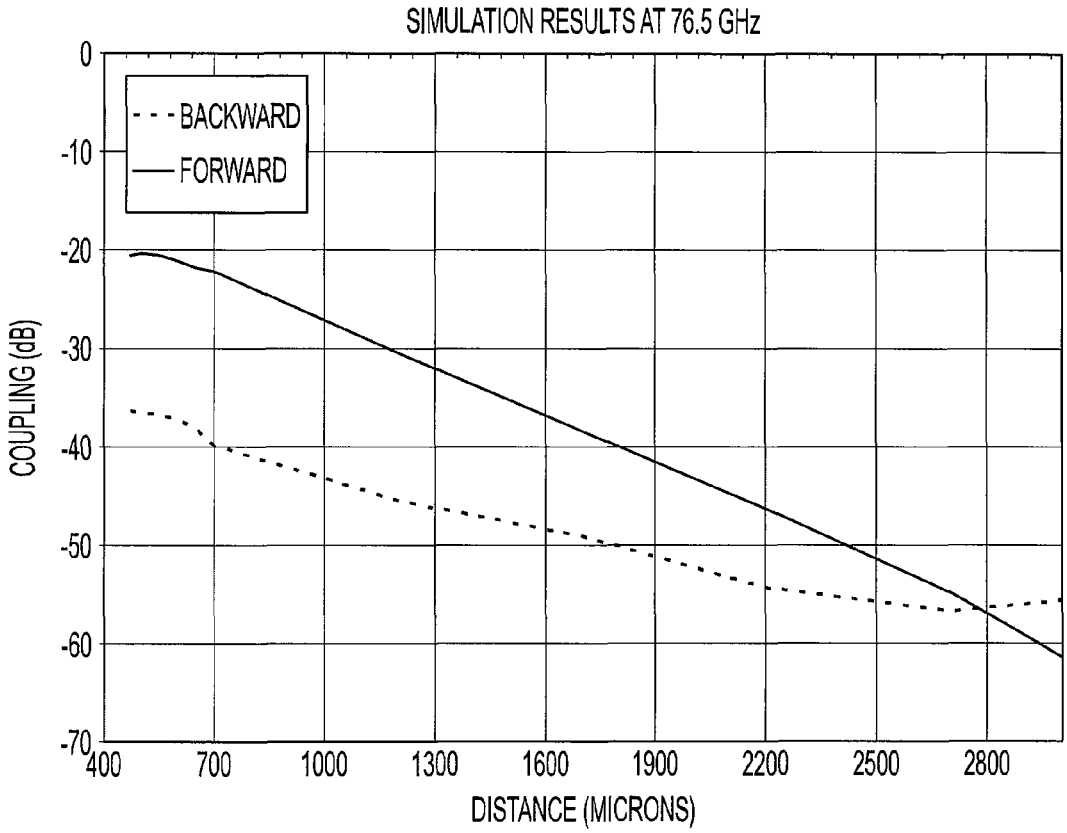
FIG. 18 is a graph showing the crosstalk (backward and forward coupling) between the two microstrip lines of FIG. 8 propagating signals at 76.5 GHz with a single metallized via fence positioned between the two microstrip lines according to an embodiment of the invention.

FIG. 18 is a graph with distance in microns on the x-axis and coupling in dB on the y-axis showing the crosstalk (backward and forward coupling) between the two microstrip lines 801 and 802 of FIG. 8 propagating signals at 76.5 GHz with a single metallized via fence 800 positioned between the two microstrip lines 801 and 802 according to an embodiment of the invention. The center-to-center spacing s between adjacent vias 805 is about 0.75 mm. The lateral separation C (Distance) between adjacent microstrip lines 801 and 802 varies as shown in the graph. An isolation of more than 30 dB can be achieved when the lateral separation C is 1.2 mm or greater.

Figure 19:
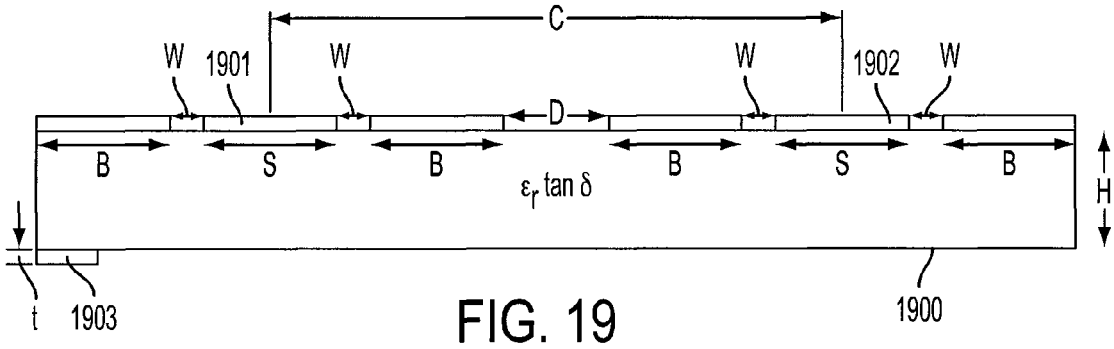
FIG. 19 is a cross-sectional view of adjacent CPW lines formed on a LCP substrate ($\epsilon$=3.16, tan $\delta$, thickness H) according to an embodiment of the invention.

FIG. 19 is a cross-sectional view of adjacent CPW lines 1901 and 1902 formed on a LCP substrate 1900 ($\epsilon_r$=3.16, tan δ, thickness H) according to an embodiment of the invention. The two adjacent CPW lines 1901 and 1902 with ground plane width B, slot W, signal line width S and distance D are printed on the LCP substrate 1900. The thickness of a copper trace 1903 is t.

Figure 20:
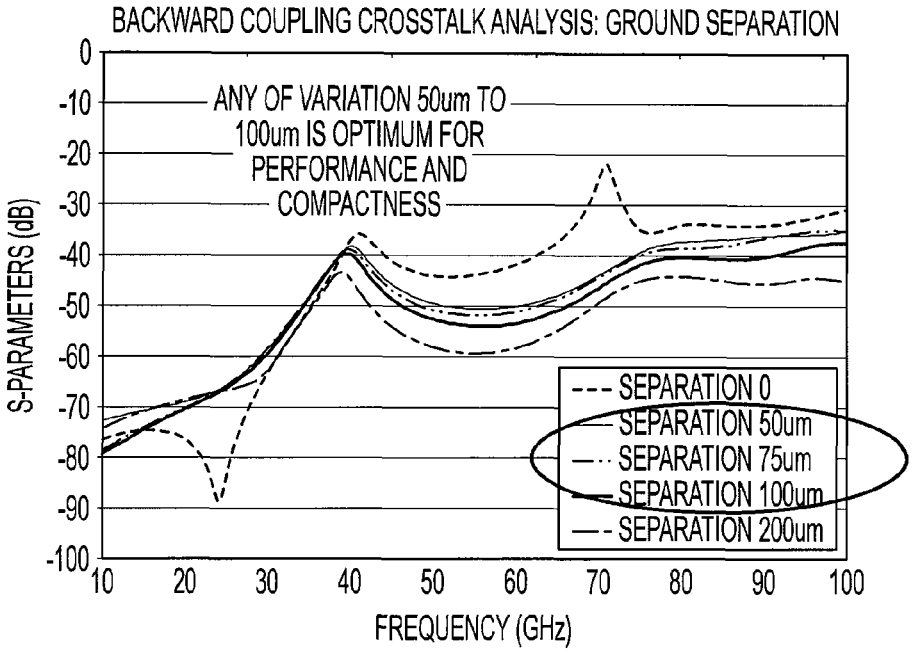
FIG. 20 is a graph showing the crosstalk (backward coupling) between the two adjacent CPW lines for various values of ground plane separation D according to various embodiments of the invention.

FIG. 20 is a graph with frequency in GHz on the x-axis and S-Parameters for backward coupling in dB on the y-axis showing the crosstalk (backward coupling) between the two adjacent CPW lines 1901 and 1902 of FIG. 19 for various values of ground plane separation D (i.e., 0 μm, 50 μm, 75 μm, 100 μm and 200 μm) according to various embodiments of the invention. When D is 0, the two adjacent CPW lines 1901 and 1902 have a common ground. This provides an increased value for crosstalk due to surface wave modes that propagate under the common ground plane. A 75 μm to 100 μm ground plane separation D between the CPW ground planes allows for the optimal reduction in crosstalk.

Figure 21:
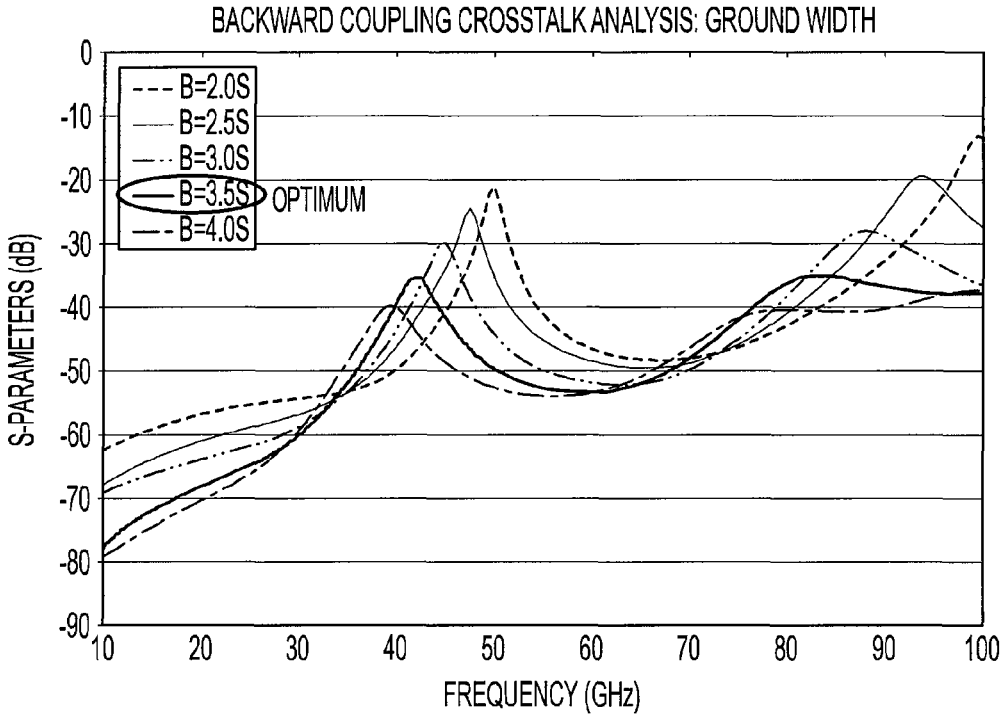
FIG. 21 is a graph showing the crosstalk (backward coupling) between the two adjacent CPW lines for various values of ground plane width B according to various embodiment of the invention.

FIG. 21 is a graph with frequency in GHz on the x-axis and S-Parameters for backward coupling in dB on the y-axis showing the crosstalk (backward coupling) between the two adjacent CPW lines 1901 and 1902 of FIG. 19 for various values of ground plane width B (i.e. 2.0 S, 2.5 S, 3.0 S, 3.5 S, 4.0 S) according to various embodiment of the invention. The optimal ground plane width B is achieved when B=3.5 S.

Figure 22:
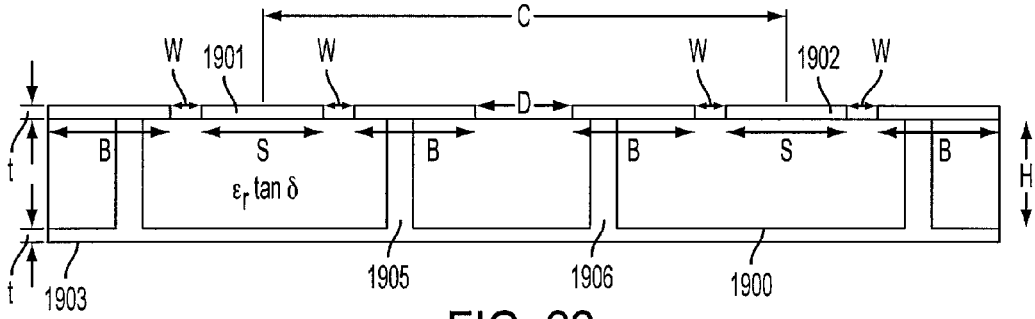
FIG. 22 is a cross-sectional view of adjacent CPW lines formed on the LCP substrate ($\epsilon$=3.16, tan $\delta$, thickness H) with the addition of two adjacent rows of metallized via fences positioned between the two adjacent CPW lines according to an embodiment of the invention.

FIG. 22 is a cross-sectional view of adjacent CPW lines 1901 and 1902 formed on the LCP substrate 1900 ($\epsilon_r$=3.16, tan δ, thickness H) with the addition of two adjacent rows of metallized via fences 1905 and 1906 positioned between the two adjacent CPW lines 1901 and 1902 according to an embodiment of the invention. The two adjacent CPW lines 1901 and 1902 with ground plane width B, slot W, signal line width S and distance D are printed on the LCP substrate 1900. The thickness of a copper trace 1903 is t. The two rows of metallized via fences 1905 and 1906 positioned between the two adjacent CPW lines 1901 and 1902 improves the isolation by about 20 dB as compared with the crosstalk (backward and forward coupling) between the two adjacent lines 1901 and 1902 when no via fence is present. The improved isolation is important at locations close to the feed of the T/R module.

Figure 23:
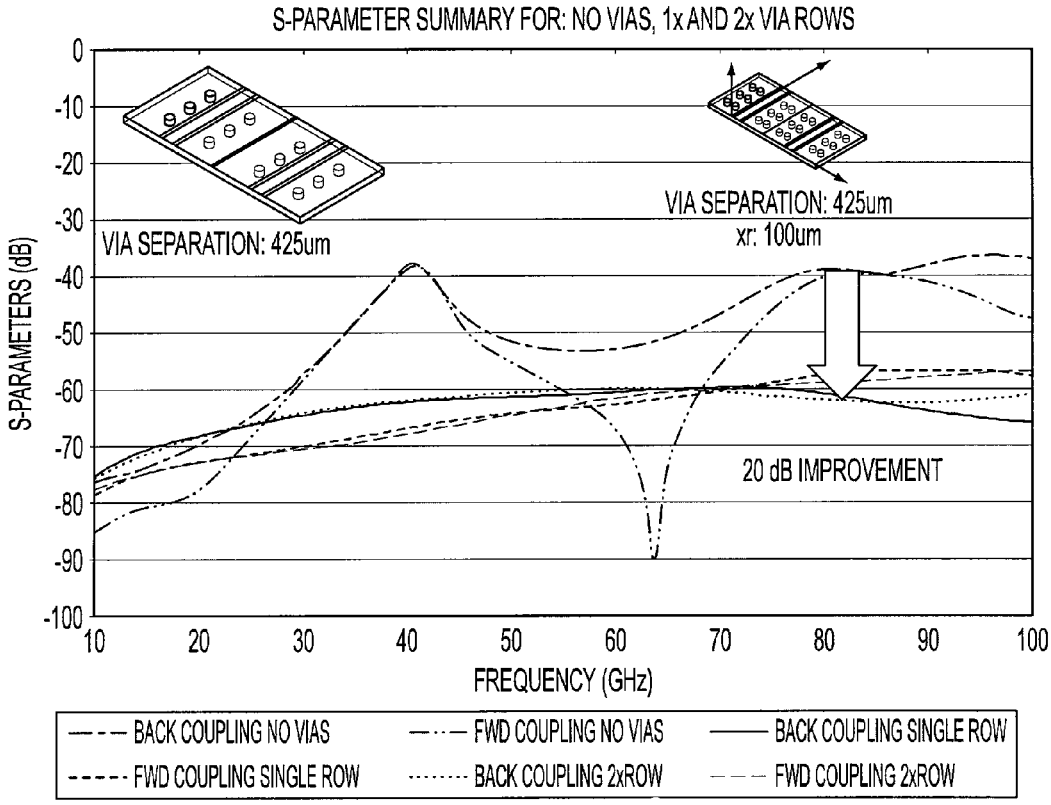
FIG. 23 is a graph showing the crosstalk (backward and forward coupling) between the two adjacent CPW lines when no via fence is present, a single via fence is present, and a double via fence is present according to various embodiment of the invention.

FIG. 23 is a graph with frequency in GHz on the x-axis and S-Parameter for forward and backward coupling in dB on the y-axis showing the crosstalk (backward and forward coupling) between the two adjacent CM lines 1901 and 1902 of FIG. 22 when no via fence is present (corresponding to "NO VIAS" in FIG. 23), a single via fence with center-to-center via spacing S equal to approximately 425 μm is present (corresponding to "SINGLE or 1× ROW" in FIG. 23), and a double via fence with center-to-center via spacing S equal to approximately 425 μm and distance xr between adjacent double rows equal to approximately 100 μm is present (corresponding to "2× ROW" in FIG. 23) according to various embodiment of the invention. The 20 dB improvement in crosstalk as disclosed above in the preceding paragraph is shown by a downward block arrow in FIG. 23.

Those of ordinary skill would appreciate that the various illustrative logical blocks, modules, and algorithm steps described in connection with the examples disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosed apparatus and methods.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. An apparatus for reducing crosstalk comprising:

a substrate having a bottom surface and a top surface defining a horizontal plane;

a ground plane coupled to the bottom surface of the substrate;

first and second microstrip lines formed on the top surface of the substrate, the first and second microstrip lines formed on the top surface of the substrate and spaced apart from one another;

a first plurality of vias traveling through the substrate from the top surface of the substrate to the ground plane and positioned between the first and second microstrip lines for reducing crosstalk between the first and second microstrip lines, the first plurality of vias including a first row of vias and a second row of vias positioned parallel to the first row of vias to form a double via fence; and a second plurality of vias traveling through the substrate from the top surface of the substrate to the ground plane and positioned between the first and second microstrip lines for reducing crosstalk between the first and second microstrip lines.

2. The apparatus of claim 1 wherein the ground plane is broken between the first and second microstrip lines to reduce crosstalk between the first and second microstrip lines.

3. The apparatus of claim 1 wherein the ground plane is broken between the first plurality of vias and the second plurality of vias.

4. The apparatus of claim 1 wherein the substrate is a liquid crystal polymer substrate.

5. The apparatus of claim 1 wherein the first and second microstrip lines are coplanar waveguides.

6. The apparatus of claim 1 wherein a center-to-center distance between adjacent vias of the first row or adjacent vias of the second row is between about 0.5 mm to about 1.0 mm.

7. The apparatus of claim 1 wherein a center-to-center lateral separation between the first and second microstrip lines is between about 500 μm to about 1500 μm.

8. The apparatus of claim 1 wherein each of the first plurality of vias is filled with a metal material.

9. The apparatus of claim 1 wherein the second plurality of vias includes a first row of vias and a second row of vias positioned parallel to the first row of vias of the second plurality of vias to form a double via fence of the second plurality of vias.

10. The apparatus of claim 1 wherein each of the second plurality of vias is filled with a metal material.

11. The apparatus of claim 1 further comprising a RFIC chip positioned on the substrate and connected to the first and second microstrip lines.

12. An apparatus for reducing crosstalk comprising:

a liquid crystal polymer substrate having a bottom surface and a top surface;

a broken ground plane having first and second sides separated by an opening, the broken ground plane coupled to the bottom surface of the liquid crystal polymer substrate;

first and second coplanar waveguides formed on the top surface of the liquid crystal polymer substrate, the first and second coplanar waveguides spaced apart from one another, the first coplanar waveguide is formed over the first side of the broken ground plane and the second coplanar waveguide is formed over the second side of the broken ground plane;

a first plurality of vias traveling through the substrate from the top surface of the substrate to the first side of the broken ground plane and positioned between the first and second coplanar waveguides for reducing crosstalk between the first and second coplanar waveguides, the first plurality of vias including a first row of vias and a second row of vias positioned parallel to the first row of vias to form a double via fence;

a second plurality of vias traveling through the substrate from the top surface of the substrate to the second side of the broken ground plane and positioned between the first and second coplanar waveguides for reducing crosstalk between the first and second coplanar waveguides; and a RFIC chip positioned on the liquid crystal polymer substrate and connected to the first and second coplanar waveguides.

13. The apparatus of claim 12 wherein a center-to-center distance between adjacent vias in each of the first plurality of vias or the second plurality of vias is between about 0.5 mm to about 1.0 mm.

14. The apparatus of claim 12 wherein a center-to-center lateral separation between the first and second coplanar waveguides is between about 500 μm to about 1500 μm.

15. The apparatus of claim 12 wherein each of the first plurality of vias is filled with a metal material.

16. The apparatus of claim 12 wherein each of the second plurality of vias is filled with a metal material.

* * * * *